US010334342B2

(12) United States Patent
Hong et al.

(10) Patent No.: US 10,334,342 B2
(45) Date of Patent: Jun. 25, 2019

(54) NECKBAND WIRELESS SOUND TRANSDUCER

(71) Applicant: EM-TECH. Co., Ltd., Busan (KR)

(72) Inventors: Choong Sheek Hong, Gyeonggi-do (KR); Joong Hak Kwon, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 15/671,537

(22) Filed: Aug. 8, 2017

(65) Prior Publication Data

US 2018/0048952 A1 Feb. 15, 2018

(30) Foreign Application Priority Data

Aug. 9, 2016 (KR) ..... 10-2016-0101468

(51) Int. Cl.

| | |
|---|---|
| ***H04R 1/10*** | (2006.01) |
| ***H04R 5/033*** | (2006.01) |
| ***H04R 5/02*** | (2006.01) |
| ***G10K 11/175*** | (2006.01) |
| ***H04R 1/02*** | (2006.01) |
| *H04R 3/00* | (2006.01) |

(52) U.S. Cl.

CPC ..... *H04R 1/10* (2013.01); *G10K 11/175* (2013.01); *H04R 1/02* (2013.01); *H04R 1/1041* (2013.01); *H04R 5/02* (2013.01); *H04R 5/0335* (2013.01); *H04R 3/00* (2013.01); *H04R 2201/023* (2013.01); *H04R 2420/01* (2013.01); *H04R 2420/07* (2013.01)

(58) Field of Classification Search

CPC ..... H04R 1/02; H04R 1/10; H04R 1/1041; H04R 3/12; H04R 5/02; H04R 5/0335; H04R 2201/023; H04R 2420/01; H04R 2420/07

USPC ..... 381/74, 309, 370, 374, 376, 377, 378, 381/379, 182, 71.1; 379/430

See application file for complete search history.

(56) References Cited

U.S. PATENT DOCUMENTS 5,815,578 A * 9/1998 Foster ..... H04R 3/00 381/1
6,062,337 A * 5/2000 Zinserling ..... H04R 5/0335 181/129
2002/0181727 A1* 12/2002 Shen ..... H04R 1/105 381/370

(Continued)

*Primary Examiner* — Huyen D Le
(74) *Attorney, Agent, or Firm* — Murphy, Bilak & Homiller, PLLC

(57) ABSTRACT

The present invention relates to a neckband-type wireless sound transducer, and more particularly, to a neckband-type wireless sound transducer that prevents sound from being transferred to the surroundings of the wearer. The neckband-type wireless sound transducer according to the present invention, includes: a main body part configured to be seated on a human body; a main speaker part mounted on the main body part and configured to emit sound to the inside of the main body part; an auxiliary speaker part mounted on the main body part and configured to emit sound for leakage reduction to offset the sound emitted by the main speaker part and leaked to the outside of the main body part; and a controller configured to apply an electric signal for sound emission to the main speaker part and an electric signal for leakage reduction to the auxiliary speaker part.

11 Claims, 3 Drawing Sheets

(56) References Cited

U.S. PATENT DOCUMENTS

2017/0053641 A1* 2/2017 Kamdar ..... H04R 3/12

* cited by examiner

NECKBAND WIRELESS SOUND TRANSDUCER

PRIORITY CLAIM

The present application claims priority to Korean Patent Application No, 10-2016-0101468 filed on 9 Aug. 2016, the content of said application incorporated herein by reference in its entirety.

TECHNICAL FIELD

The present invention relates to a neckband-type wireless sound transducer, and more particularly, to a neckband-type wireless sound transducer that prevents sound from being transferred to the surroundings of the wearer.

BACKGROUND

As a multimedia such as a broadcasting phone or a PMP phone has been built in a smartphone as a main function, the user can enjoy various contents through their smartphone. The demand for a wireless headset has also been increasing with these trends.

Among the wireless communication techniques, Bluetooth, which is a standard for wireless communication between wireless communication devices at a short distance with low power, serves to process data transmission between devices such as a computer, a smartphone, a headset, a personal digital assistant (PDA), a personal computer (PC), and a printer. Bluetooth is a communication technology that can transmit and receive data wirelessly, usually between 10 meters and maximally several hundred meters. A neckband-type speaker for reproducing sound, with being worn around the wearer's neck, without a separate communication cable, has been developed using such a technology and sold on the market.

In addition, the sound generated by the conventional neckband-type speaker is transmitted not only to the wearer but also to the surroundings of the wearer, which disturbs the wearer listening to the sound and unwantedly transfers the sound to the people around the wearer.

SUMMARY

An object of the present invention is to provide a neckband-type wireless sound transducer that prevents sound from being transferred to the surroundings of the wearer or in an outward direction from the sound transducer.

According to an aspect of the present invention, there is provided a neckband-type wireless sound transducer, including: a main body part which is seated on a human body; a main speaker part which is mounted on the main body part and emits sound to the inside of the main body part; an auxiliary speaker part which is mounted on the main body part and emits sound for leakage reduction to offset the sound emitted by the main speaker part and leaked to the outside of the main body part; and a controller which applies an electric signal for sound emission to the main speaker part and an electric signal for leakage reduction to the auxiliary speaker part.

In some embodiments, at least one speaker included in the main speaker part and at least one speaker for reduction included in the auxiliary speaker part are preferably symmetrical with respect to the center of the main body part.

In some embodiments, the speaker for reduction preferably emits sound for leakage reduction toward the outside of the main body part.

In some embodiments, the controller preferably applies the electric signal for leakage reduction to the speaker for reduction after a delay time proportional to an interval between the speaker of the main speaker part and the speaker for reduction.

In some embodiments, the delay time is preferably calculated as (the interval)/(sound speed).

In some embodiments, the electric signal applied to the speaker of the main speaker part and the electric signal for leakage reduction are preferably opposite in phase to each other.

In some embodiments, at least one speaker included in the main speaker part is preferably provided in a groove formed in the main body part.

In some embodiments, the groove formed in the main body part is preferably inclined in a direction toward the center of the main body part.

According to the present invention, there are the effects of improving the directivity to the wearer's auditory organ and preventing sound from being transferred to the surroundings of the wearer or in an outward direction from the sound transducer, thus ensuring only the wearer to appreciate the sound and preventing the sound from being unwantedly transferred to the people around the wearer.

Those skilled in the art will recognize additional features and advantages upon reading the following detailed description, and upon viewing the accompanying drawings.

DETAILED DESCRIPTION

Hereinafter, a preferred embodiment of a neckband-type wireless sound transducer according to the present invention will be described in detail with reference to the accompanying drawings.

Figure 1:
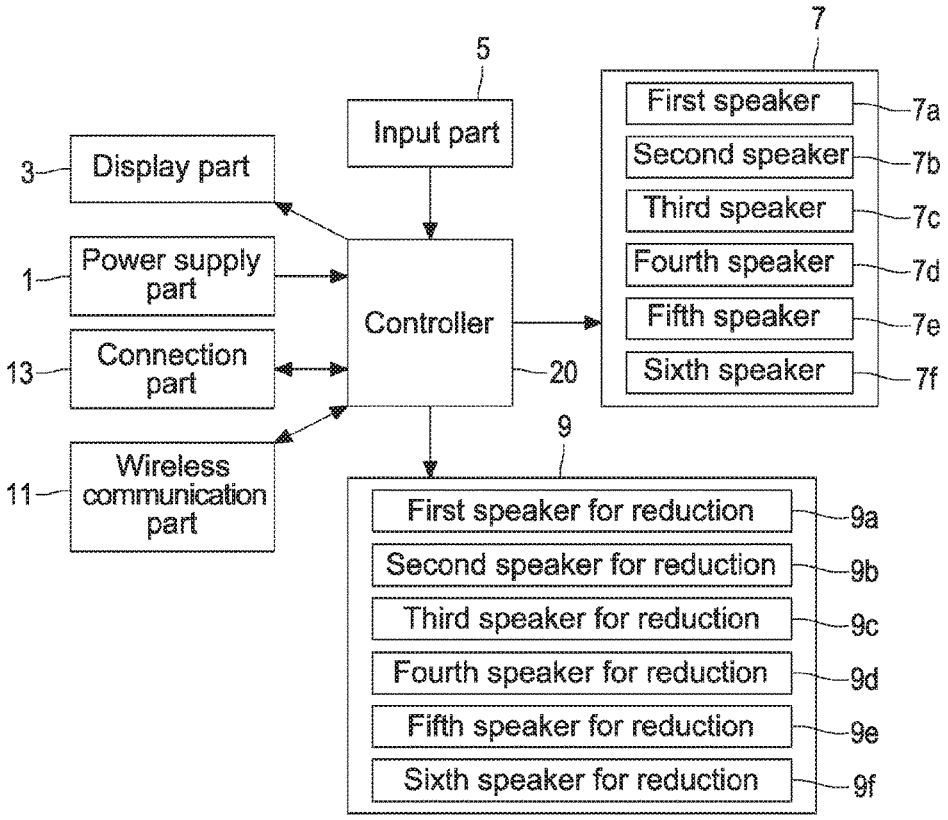
FIG. 1 is a block diagram of a neckband-type wireless sound transducer according to the present invention.
Figure 2A:
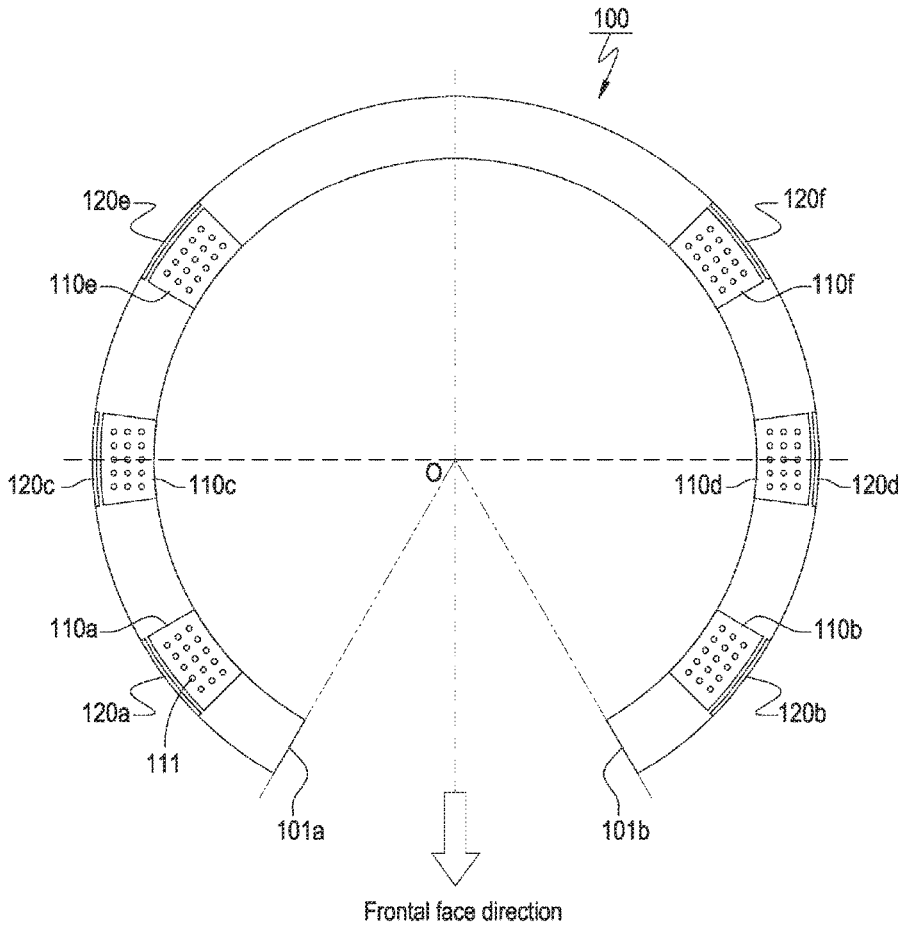
FIGS. 2*a* and 2*b* are a top view and a perspective view of the neckband-type wireless sound transducer of FIG. 1.
Figure 2B:
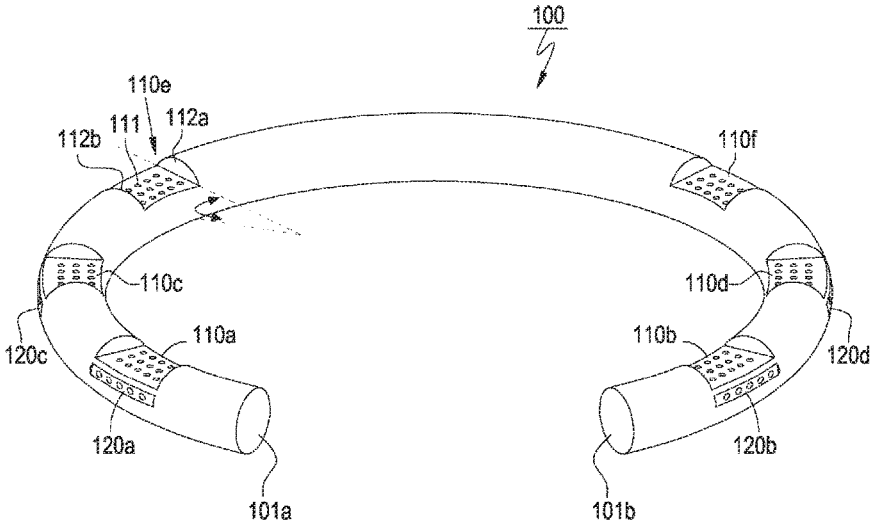

FIG. 1 is a block diagram of a neckband-type wireless sound transducer according to the present invention, and FIGS. 2*a* and 2*b* are a top view and a perspective view, respectively, of the neckband-type wireless sound transducer of FIG. 1.

The neckband-type wireless sound transducer includes a power supply part 1 which supplies power, a display part 3 which displays information (operation state, charging state, volume level, played music information, etc.) to the user, an input part 5 which acquires an input (operation control/stop control, volume level adjustment control, played music selection, etc.) from the user, a main speaker part 7 which is mounted on a main body part 100, disposed toward the wearer's auditory organ, and composed of first to sixth speakers 7*a* to 7*f*, an auxiliary speaker part 9 which is mounted on the main body part 100 and composed of first to sixth speakers 9*a* to 9*f* for reduction that serve to reduce the sound generated by the main speaker part 7 and leaked(or emitted) to the outside of the main body part, a wireless communication part 11 which performs wireless communication (e.g., Bluetooth communication, Wi-Fi communication, etc.) with an external electric communication device, a connection part 13 which is connected to the external electric communication device by wire, and a controller 20 that receives power from the power supply part 1, receives sound data through the wireless communication part 11 according to the input from the input part 5, and plays and emits sound through the main speaker part 7, or receives sound data from the connection part 13 and plays and emits sound through the main speaker part 7, the controller 20 generating and emitting sound for leakage reduction through the auxiliary speaker part 9 so as to reduce sound leakage to the outside of the main body part (i.e., to the surroundings of the wearer) and displaying information such as operation state through the display part 3, when emitting the sound through the main speaker part 7. Here, it is noted that the power supply part 1, the display part 3, the input part 5, the wireless communication part 11 and the connection part 13 are easily recognized by those skilled in the art, so the detailed description thereof is omitted.

In addition, the neckband-type wireless sound transducer according to the present invention includes an annular main body part 100 having a first end 101*a* and a second end 101*b*, an opening being formed between the first end 101*a* and the second end 101*b* of the main body part 100. The main body part 100 is provided with first to sixth sound-emitting grooves 110*a* to 110*f* (collectively referred to as '110'), each having a plurality of sound-emitting holes 111, the sound-emitting grooves 110 being formed in the main body part 100 in a stepped or concave manner with respect to the surface of the main body part 100, groove ends 112*a* and 112*b* facing each other being formed on both sides of the sound-emitting grooves 110 to allow the sound generated by the first to sixth speakers 7*a* to 7*f* to be emitted in a straightforward manner to the wearer's auditory organ. Alternatively, it is also possible to provide a dish-shaped structure that surrounds the entire peripheries of the sound-emitting grooves 110 and is opened toward the upper space of the center O (or toward the wearer's auditory organ) to improve the straightforward emission of the sound.

The first to sixth speakers 7*a* to 7*f* are mounted in the sound-emitting grooves 110*a* to 110*f* (in the main body part 100), respectively, and the sound (or audio) from the first to sixth speakers 7*a* to 7*f* is transferred to the outside or the wearer's auditory organ through the sound-emitting holes 111. The first and sixth sound-emitting grooves 110*a* and 110*f* are symmetrically arranged with respect to the center O of the main body part 100, and also the second and fifth sound-emitting grooves 110*b* and 110*e*, and the third and fourth sound-emitting grooves 110*c* and 110*d*, are symmetrical with respect to the center O of the main body part 100, respectively. As shown in FIG. 2*b*, the sound-emitting grooves 110 are inclined in a direction toward the center of the main body part 100 at a certain angle to the horizontal direction, and the inclined sound-emitting grooves 110 allow the sound-emitting holes 111 to be directed toward a higher part than the center O of the main body part 100, for example, toward the wearer's auditory organ.

The lower portion of the main body part 100 is seated on the user's back, shoulders, neck, etc., such that the sound-emitting holes 111 are structurally directed toward the user's auditory organ.

Moreover, the main body part 100 includes first to sixth sound-emitting grooves 120*a* to 120*f* for reduction, each having a plurality of sound-emitting holes 111, through which the sound for leakage reduction from the first to sixth speakers 9*a* to 9*f* for reduction is emitted. The first to sixth sound-emitting grooves 120*a* to 120*f* for reduction are disposed toward the outside of the main body part 100 to emit the sound to the outside of the main body part 100. The first and sixth sound-emitting grooves 120*a* and 120*f* for reduction are symmetrically arranged with respect to the center O of the main body part 100, and also the second and fifth sound-emitting grooves 120*b* and 120*e* for reduction, and the third and fourth sound-emitting grooves 120*c* and 120*d* for reduction, are symmetrical with respect to the center O of the main body part 100, respectively.

Further, the first sound-emitting groove 110*a* and the sixth sound-emitting groove 120*f* for reduction are symmetrical with respect to the center O, and also the second sound-emitting groove 110*b* and the fifth sound-emitting groove 120*e* for reduction, the third sound-emitting groove 110*c* and the fourth sound-emitting groove 120*d* for reduction, the fourth sound-emitting groove 110*d* and the third sound-emitting groove 120*c* for reduction, the fifth sound-emitting groove 110*e* and the second sound-emitting groove 120*b* for reduction, and the sixth sound-emitting groove 110*f* and the first sound-emitting groove 120*a* for reduction are symmetrical with respect to the center O, respectively.

The center (middle) of the opening corresponds to the middle between the first end 101*a* and the second end 101*b*, and the main body part 100 is formed symmetrically with respect to a first extension line connecting the center of the opening and the center O of the main body part 100. The opening is disposed in a frontal face direction of the wearer, as indicated by an arrow of FIG. 2*a*.

The first to sixth speakers 7*a* to 7*f* are mounted in the main body part 100, corresponding to the first to sixth sound-emitting grooves 110*a* to 110*f*, respectively, and controlled separately or together by the controller 20. The first to sixth speakers 7*a* to 7*f* emit sound in an inward direction of the main body part 100 (toward the center O) so that the sound can reach the wearer's auditory organ positioned on the inside of the main body part 100. Furthermore, for example, for 2.1 channel, the first and second speakers 7*a* and 7*b*, and the fifth and sixth speakers 7*e* and 7*f*, may be woofer speakers, while the third speaker 7*c* and the fourth speaker 7*d* may be right and left speakers, respectively.

The first to sixth speakers 9*a* to 9*f* for reduction are mounted in the main body part 100, corresponding to the first to sixth sound-emitting grooves 120*a* to 120*f* for reduction, respectively, and controlled separately or together by the controller 20. The first speaker 9*a* for reduction prevents the sound from the sixth speaker 7*f*, which is symmetrically positioned thereto with respect to the center O, from being leaked to the outside of the main body part 100, the second speaker 9*b* for reduction prevents the sound from the fifth speaker 7*e*, which is symmetrically positioned thereto with respect to the center O, from being leaked to the outside of the main body part 100, the third speaker 9*c* for reduction prevents the sound from the fourth speaker 7*d*, which is symmetrically positioned thereto with respect to the center O, from being leaked to the outside of the main body part 100, the fourth speaker 9*d* for reduction prevents the sound from the third speaker 7*c*, which is symmetrically positioned thereto with respect to the center O, from being leaked to the outside of the main body part 100, the fifth speaker 9*e* for reduction prevents the sound from the second speaker 7*b*, which is symmetrically positioned thereto with respect to the center O, from being leaked to the outside of the main body part 100, and the sixth speaker 9*f* for reduction prevents the sound from the first speaker 7*a*, which is symmetrically positioned thereto with respect to the center O, from being leaked to the outside of the main body part 100.

The power supply part 1, the wireless communication part 11 and the controller 20 are mounted on the inside of the main body part 100, while the display part 3, the input part 5 and the connection part 13 are provided on the side surfaces of the main body part 100 to be externally shown.

The controller 20 receives sound data (e.g., MP3, MP4, audio data, etc.) from an electric communication device (e.g., smartphone, MP3 player, etc.) through the wireless communication part 11 and converts it into an electric signal playable by the speaker part 7, using a built-in playing program such as Codec. Upon the conversion into the electric signal, the controller 20 may convert the sound data into an electric signal which is a stereo signal or into an electric signal which is a multi-channel channel signal for multi-channel play (e.g., 2.1 channel, 3.1 channel, 4.1 channel, 5.1 channel, etc.). For the purpose of converting the sound data into the electric signal, the controller 20 receives an input for selection of a sound type (e.g., stereo, multi-channel, etc.) from the input part 5 and controls the built-in playing program according to the input for selection.

The controller 20 generates an electric signal for sound playing and applies the electric signal to the speaker part 7 so that it can play sound. Particularly, in the case of stereo playing or multi-channel playing, the controller 20 applies the same or different electric signals to the first to sixth speakers 7*a* to 7*f* or selectively applies the electric signals to the first to sixth speakers 7*a* to 7*f*, so that they can play sound.

In addition, in order to prevent the sound emitted by the speaker part 7 from being leaked to the outside of the main body part 100 so that people other than the wearer could hear the sound, the controller 20 controls the sixth to the first speakers 9*f* to 9*a* for playing to emit, to the outside of the main body part 100, the sound having the opposite phase to the sound emitted by the first to sixth speakers 7*a* to 7*f*. Hereinafter, this process will be described in detail.

Figure 3:
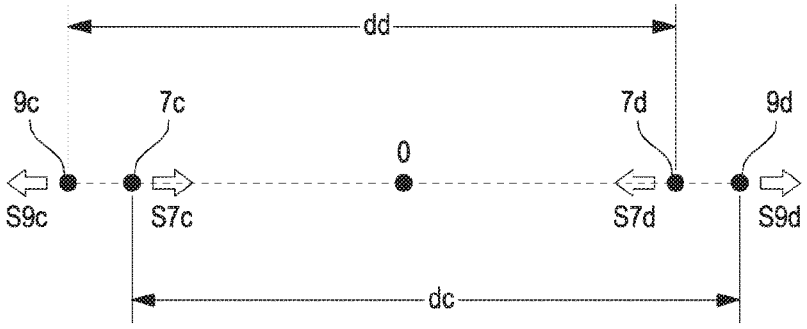
FIG. 3 is an explanatory view of a leakage reduction principle of the neckband-type wireless sound transducer of FIG. 1.

FIG. 3 is an explanatory view of a leakage reduction principle of the neckband-type wireless sound transducer of FIG. 1.

The third and fourth speakers 7*c* and 7*d* are arranged symmetrically with respect to the center O of the main body part 100, the third speaker 9*c* for reduction being disposed on the extension line between the fourth speaker 7*d* and the center O, the fourth speaker 9*d* for reduction being disposed on the extension line between the third speaker 7*c* and the center O. The interval between the third speaker 7*c* and the fourth speaker 9*d* for reduction is a distance dc, while the interval between the fourth speaker 7*d* and the third speaker 9*c* for reduction is a distance dd.

The sound emitted by the third speaker 7*c* reaches the fourth speaker 9*d* for reduction after a delay time (dc/c: c is a sound speed). The controller 20 stores the delay time proportional to the distance dc, starts to apply an electric signal to the third speaker 7*c*, then generates an electric signal for leakage reduction, which is opposite in phase to the electric signal applied to the third speaker 7*c*, applies the electric signal for leakage reduction to the fourth speaker 9*d* for reduction after the delay time, and allows the fourth speaker 9*d* for reduction to emit the sound for leakage reduction to the outside of the main body part 100, such that the sound emitted by the third speaker 7*c* is offset by the sound for leakage reduction that is emitted by the fourth speaker 9*d* for reduction, on the outside of the main body part 100, that is, in an outward direction from the fourth speaker 9*d* for reduction. This sound offsetting operation considerably reduces the volume level of the sound from the third speaker 7*c* on the outside of the main body part 100.

With the same principle, the sound emitted by the fourth speaker 7*d* is offset on the outside of the main body part 100 by the sound for leakage reduction that is emitted by the third speaker 9*c* for reduction. This principle equally applies to the sound of the first and second speakers 7*a* and 7*b* and to the sound of the fifth and sixth speakers 7*e* and 7*f*.

While this invention has been described in connection with what is presently considered to be practical exemplary embodiments, it is to be understood by those skilled in the art that the invention is not limited to the disclosed embodiments, but on the contrary, is intended to cover various modifications and equivalent arrangements included within the spirit and scope of the appended claims.

What is claimed is:

1. A neckband wireless sound transducer, comprising:

a main body part configured to be seated on a human body;

a main speaker part mounted on the main body part and configured to emit sound to the inside of the main body part;

an auxiliary speaker part mounted on the main body part and configured to emit sound for leakage reduction to offset the sound emitted by the main speaker part and leaked to the outside of the main body part; and a controller configured to apply an electric signal for sound emission to the main speaker part and an electric signal for leakage reduction to the auxiliary speaker part, wherein at least one speaker included in the main speaker part is provided in a groove formed in the main body part, wherein the groove formed in the main body part is inclined in a direction toward a center of the main body part.

2. The neckband wireless sound transducer of claim 1, wherein the at least one speaker included in the main speaker part and at least one speaker for reduction included in the auxiliary speaker part are symmetrical with respect to the center of the main body part.

3. The neckband wireless sound transducer of claim 2, wherein the at least one speaker for reduction is configured to emit sound for leakage reduction toward the outside of the main body part.

4. The neckband wireless sound transducer of claim 2, wherein the controller is configured to apply the electric signal for leakage reduction to the at least one speaker for reduction after a delay time proportional to an interval between the least one speaker included in the main speaker part and the at least one speaker for reduction.

5. The neckband wireless sound transducer of claim 4, wherein the delay time is calculated as an interval between the at least one speaker included in the main speaker part and the at least one speaker for reduction divided by sound speed.

6. The neckband wireless sound transducer of claim 4, wherein the electric signal applied to the at least one speaker of the main speaker part and the electric signal for leakage reduction are opposite in phase to each other.

7. A neckband wireless sound transducer, comprising:

a main body part configured to be seated on a human body;

a main speaker part mounted on the main body part and configured to emit sound to the inside of the main body part;

an auxiliary speaker part mounted on the main body part and configured to emit sound for leakage reduction to offset the sound emitted by the main speaker part and leaked to the outside of the main body part; and a controller configured to apply an electric signal for sound emission to the main speaker part and an electric signal for leakage reduction to the auxiliary speaker part, wherein at least one speaker included in the main speaker part and at least one speaker for reduction included in the auxiliary speaker part are symmetrical with respect to a center of the main body part.

8. The neckband wireless sound transducer of claim 7, wherein the at least one speaker for reduction is configured to emit sound for leakage reduction toward the outside of the main body part.

9. The neckband wireless sound transducer of claim 7, wherein the controller is configured to apply the electric signal for leakage reduction to the at least one speaker for reduction after a delay time proportional to an interval between the least one speaker included in the main speaker part and the at least one speaker for reduction.

10. The neckband wireless sound transducer of claim 9, wherein the delay time is calculated as an interval between the at least one speaker included in the main speaker part and the at least one speaker for reduction divided by sound speed.

11. The neckband wireless sound transducer of claim 9, wherein the electric signal applied to the at least one speaker of the main speaker part and the electric signal for leakage reduction are opposite in phase to each other.

* * * * *